US006629067B1

(12) United States Patent
Saito et al.

(10) Patent No.: US 6,629,067 B1
(45) Date of Patent: Sep. 30, 2003

(54) RANGE CONTROL SYSTEM

(75) Inventors: Tsutomu Saito, Hamamatsu (JP); Hiroshi Kato, Hamamatsu (JP); Youichi Kondo, Hamamatsu (JP)

(73) Assignee: Kabushiki Kaisha Kawai Gakki Seisakusho (JP)

( * ) Notice: Subject to any disclaimer, the term of this patent is extended or adjusted under 35 U.S.C. 154(b) by 0 days.

(21) Appl. No.: 09/079,025

(22) Filed: May 14, 1998

(30) Foreign Application Priority Data

May 15, 1997 (JP) ..... 9-139194

(51) Int. Cl.[7] ..... G10L 11/04

(52) U.S. Cl. ..... 704/207; 704/268; 704/206; 704/209; 704/267; 381/56; 381/66; 84/622; 84/659; 84/609; 84/610

(58) Field of Search ..... 704/258, 221, 704/268, 207, 206, 209, 223, 266, 270, 267; 379/390.01; 381/102, 109, 56, 66; 84/622, 659, 609, 604, 610, 645

(56) References Cited

U.S. PATENT DOCUMENTS 4,975,957 A * 12/1990 Ichikawa et al. ..... 704/220
5,054,085 A * 10/1991 Meisel et al. ..... 704/207
5,479,564 A * 12/1995 Vogten et al. ..... 704/265
5,642,470 A * 6/1997 Yamamoto et al. ..... 704/258
5,747,715 A * 5/1998 Ohta et al. ..... 84/604
5,749,071 A * 5/1998 Silverman ..... 704/258
5,847,303 A * 12/1998 Matsumoto ..... 84/610
5,889,223 A * 3/1999 Matsumoto ..... 84/609
5,963,907 A * 10/1999 Matsumoto ..... 704/270
6,307,140 B1 * 10/2001 Iwamoto ..... 84/622
6,336,092 B1 * 1/2002 Gibson et al. ..... 704/268

* cited by examiner

*Primary Examiner*—Vijay Chawan
(74) *Attorney, Agent, or Firm*—Bachman & LaPointe, P.C.

(57) ABSTRACT

A range control system includes an input section for inputting a singing voice, a fundamental frequency extracting section for extracting a fundamental frequency of the inputted voice, and a pitch control section for performing a pitch control of the inputted voice so as to match the extracted fundamental frequency with a given frequency. The system further includes a formant extracting section for extracting a formant of the inputted voice, and a formant filter section for performing a filter operation relative to the pitch-controlled voice so that the pitch-controlled voice has a characteristic of the extracted formant. The system further includes an input loudness detecting section for detecting a first loudness of the inputted voice, and a loudness control section for controlling a second loudness of the voice subjected to the filter operation to match with the first loudness. The system further includes a music information storing section storing musical information of songs to be sung, and an automatic reproducing section for reading musical information of a selected song and outputting melody information, accompaniment information and various acoustic effect information of the selected song included in the musical information.

10 Claims, 5 Drawing Sheets

RANGE CONTROL SYSTEM

BACKGROUND OF THE INVENTION

1. Field of the Invention The present invention relates to a range control system for expanding a range of an inputted voice and, in particular, to a system which can be used for a singing backup system in, for example, karaoke (recorded orchestral accompaniment) and also for a pronunciation backup system in, for example, chanting a Chinese poem or a sutra, or reading aloud a foreign language.

2. Description of the Prior Art

In karaoke, the singing backup system carries out, for example, real-time display (instructions) of lyrics of a song on a display unit, and melody line accompaniments. Thus, a person having some pitch sensitivity can sing a song to a degree that is acceptable for listeners, while watching displayed lyrics of the song and noticing at times a melody line rolling in the back.

However, even if one has some pitch sensitivity, if one's voice compass or range is narrow (differences in vocal cords among individuals are large), it is often difficult to sing a song as expected even using the foregoing singing backup system. This problem is difficult to solve even if the music is transposed to match with a voice range of a singer using a transposing function, the voice range or the sound production band itself can not be expanded.

For solving the foregoing problem, a structure has been proposed in, for example, JP-A-4-294394, wherein a real-time pitch control is performed relative to an inputted voice for matching with pitches of model musical tones or model speech signal data so as to expand a voice range of a singer.

However, if such a pitch control is simply carried out, a tone color of the inputted voice is changed to be totally different from that of the singer.

SUMMARY OF THE INVENTION

Therefore, it is an object of the present invention to provide a range-control system which, even if a range of an inputted voice is expanded, does not deteriorate or spoil a tone color thereof.

It is another object of the present invention to provide a range control system, wherein even if a loudness of a voice outputted through the foregoing range expanding process differs from that of the inputted voice, it is adjusted to the level of the inputted voice loudness.

According to one aspect of the present invention, there is provided a range control system comprising an input section for inputting a voice: a fundamental frequency extracting section for extracting a fundamental frequency of the inputted voice; a pitch control section for performing a pitch control of the inputted voice so as to match the extracted fundamental frequency with a given frequency: a formant extracting section for extracting a formant of the inputted voice: and a formant filter section for performing a filter operation relative to the pitch-controlled voice so that the pitch-controlled voice has a characteristic of the extracted formant.

It may be arranged that the range control system further comprises a storage section storing a plurality of selectable pitch sequences as reference pitches; and a reading section for selecting one of the pitch sequences and sequentially reading the corresponding reference pitches, wherein the given frequency is a frequency of the corresponding reference pitch read out by the reading section.

It may be arranged that the storage section stores each of the pitch sequences corresponding to event changes, while storing acoustic effect data having periodic changes of pitches as parameters of time, depth and speed.

It may be arranged that the range control system further comprises an input loudness detecting section for detecting a first loudness of the inputted voice: and a loudness control section for controlling a second loudness of the voice subjected to the filter operation to match with the first loudness.

It may be arranged that the loudness control section controls the second loudness based on a ratio between the first loudness and a third loudness of the voice subjected to the filter operation, the third loudness detected by a loudness detecting section.

It may be arranged that the formant extracting section sequentially extracts formants of the inputted voice.

According to another aspect of the present invention, there is provided a range control system comprising an input section for inputting a voice; a fundamental frequency extracting section for extracting a fundamental of the inputted voice: a pitch control section for performing a pitch control of the inputted voice so as to match the extracted fundamental frequency with a given frequency; a formant extracting section for extracting a formant of the inputted voice: a formant filter section for performing a filter operation relative to the pitch-controlled voice so that the pitch-controlled voice has a characteristic of the extracted formant; an input loudness detecting section for detecting a first loudness of the inputted voice; and a loudness control section for controlling a second loudness of the voice subjected to the filter operation to match with the first loudness: a storage section storing a plurality of selectable pitch sequences as reference pitches; and a reading section for selecting one of the pitch sequences and sequentially reading the corresponding reference pitches, wherein the given frequency is a frequency of the corresponding reference pitch read out by the reading section.

BRIEF DESCRIPTION OF THE DRAWINGS

The present invention will be understood more fully from the detailed description given hereinbelow, taken in conjunction with the accompanying drawings.

in the drawings.

DESCRIPTION OF THE PREFERRED EMBODIMENT

Now, preferred embodiments of the present invention will be described hereinbelow with reference to the accompanying drawings.

Figure 1:
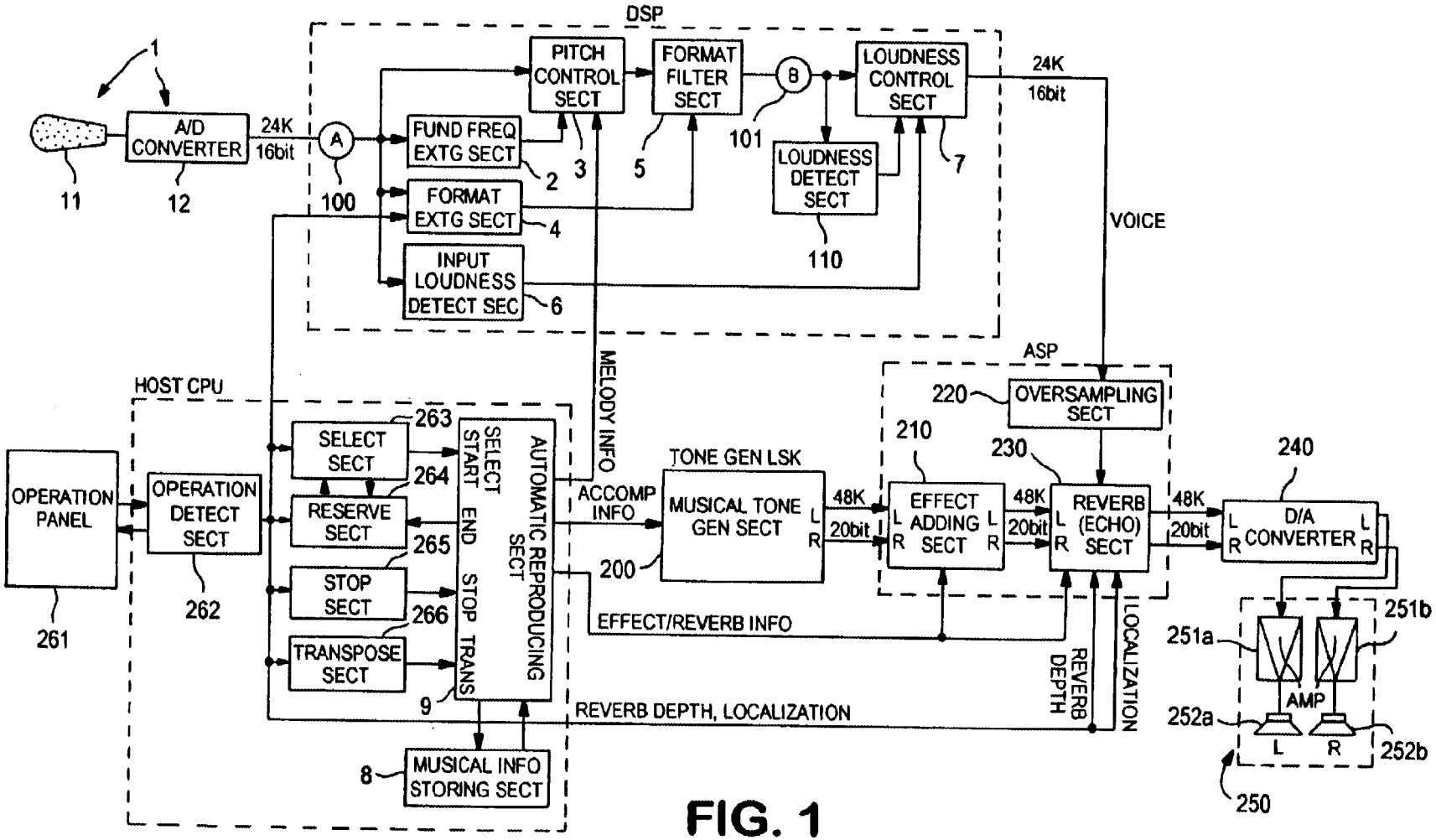
FIG. 1 is a functional block diagram showing a karaoke system, wherein a range control system according to a first preferred embodiment of the present invention is incorporated as a singing backup system for a singer.

FIG. 1 is a functional block diagram showing a karaoke system, wherein a range control system according to the first preferred embodiment of the present invention is incorporated as a singing backup system for a singer.

The shown karaoke system comprises a musical information storing section 8 storing musical information (lyrics, images, melodies, accompaniments, etc.) of songs to be sung, an automatic reproducing section 9 for reading musical information of a selected song from the musical information storing section 8 and outputting melody information, accompaniment information and various acoustic effect information (reverb information, localization information, etc.) of the song, and an input section 1 including a microphone 11 for inputting a singer's voice and an A/D converter 12 for converting an analog signal of the inputted voice into a digital signal. The karaoke system further comprises a musical tone generating section 200 for generating musical tones based on the foregoing accompaniment information, an effect adding section 210 for adding acoustic effects (tremolo, chorus, rotary speaker, distortion, etc.) matching with the song and the tone color thereof to outputted musical tone signals (or only a partial sequence of the musical tone signals) based on the foregoing various acoustic effect information so as to produce more natural musical tone signals, an oversampling section 220 for receiving a 24 KHz/16 bit speech signal outputted from a DSP (Digital Signal Processor) and converting it into a 48 KHz/20 bit signal equal to a musical tone signal, and a reverb section 230 for receiving the musical tone signal and the speech signal and adding a reverb or echo effect thereto. The karaoke system further comprises a D/A converter 240 for converting the digital musical tone and speech signals received from the reverb section 230 into corresponding analog signals, and a sound emitting section 250 including amplifiers 251*a* and 251*b* for amplifying the analog signals independently at the left and right sides and speakers 252*a* and 252*b* for emitting the signing voice and the accompaniment tones independently at the left and right sides. Further, in the karaoke system, an operation detecting section 262 monitors the state of an operation panel 261 manually operable by a user, and sends monitored state information to a music selecting section 263, a music reserving section 264, a music stopping section 265 and a transposing section 266. These sections feed commands to the automatic reproducing section 9 with respect to music selection, music reservation, music selection start, musical performance stop, transposition, reverb depth, voice localization, etc, so as to control the automatic reproducing section 9 to carry out music selection, music reservation, music selection start, musical performance stop, transposition, etc. As described later, if the operation panel 261 includes a formant extraction command key, the operation detecting section 202 sends a formant extraction trigger signal to a later-described formant extracting section 4. In the foregoing structure, the operation detecting section 262, the music selecting section 263, the music reserving section 264, the music stopping section 265, the transposing section 266, the automatic reproducing section 9 and the musical information storing section 8 are realized by a host CPU and its internal and external storages, the musical tone generating section 200 is realized by a tone generator LSI, and the effect adding section 210, the oversampling section 220 and the reverb section 230 are realized by an ASP (Audio Signal Processor).

The karaoke system further comprises the DSP for processing the speech signals inputted from the input section I and outputting them to the oversampling section 220. The DSP comprises a fundamental frequency extracting section 2 for extracting a fundamental frequency of the inputted voice, a pitch control section 3 for controlling the pitches of the inputted voice so that the extracted fundamental frequency becomes a given frequency, a formant extracting section 4 for extracting formants of the inputted voice, a formant filter section 5 for performing a filter operation so that the pitch controlled voice has a characteristic of the extracted formants, an input loudness detecting section 6 for detecting a loudness of the inputted voice, and a loudness control section 7 for controlling a loudness of the filter-operated voice to match with the detected loudness of the inputted voice. The DSP further comprises a first buffer 100 interposed between the A/D converter 12 and each of the fundamental frequency extracting section 2, the pitch control section 3, the formant extracting section 4 and the input loudness detecting section 6, a second buffer 101 interposed between the formant filter section 5 and the loudness control section 7, and a loudness detecting section 110 branching from the second buffer 101 for detecting the loudness of the filter-operated speech signals and outputting it to the loudness control section 7.

The musical information (melody information) stored in the musical information storing section 8 is in the form of a plurality of selectable pitch sequences each constituting reference pitches. A particular pitch sequence is selected by the music selecting section 263 based on an operation signal from the operation panel 261 directly or via the music reserving section 264, and read out by the automatic reproducing section 9. The foregoing pitch sequence is such data that is stored corresponding to event changes, while acoustic effect data having periodic changes of pitches, such as vibrato, is stored as parameters of time, depth and speed so as to reduce the data amount.

The microphone 11 of the input section 1 converts the inputted singing voice into analog electric signals. The A/D converter 12 of the input section 1 converts the analog signals from the microphone 11 into the digital signals (24 KHz sampling/16 bits) for signal processing at the DSP.

The DSP carries out the signal processing so as to expand a range of the inputted voice while essentially maintaining a tone color and a loudness thereof. The process for expanding the voice range is carried out by the fundamental frequency extracting section 2 and the pitch control section 3. The process for maintaining the tone color is carried out by the formant extracting section 4 and the formant filter section 5. Further, the process for maintaining the loudness is carried out by the input loudness detecting section 6 and the loudness control section 7.

Specifically, digital signals of a singing voice outputted from the A/D converter 12 are inputted and stored into the first buffer 100 in time sequence. Then, the fundamental frequency extracting section 2 extracts a fundamental frequency (pitch) of the inputted voice. Further, the musical information (melody information) outputted from the automatic reproducing section 9 is inputted into the pitch control section 3 as model reference pitches, while the fundamental frequency of the inputted voice is also inputted into the pitch control section 3. The pitch control section 3 compares the fundamental frequency with the corresponding reference pitch and matches frequencies (pitches) of the inputted voice with the reference pitch. Through such processing, a singer can sing a song without deviating from the model even in a voice range exceeding that of the singer. The first buffer 100 (and also the second buffer 101) can store speech signals of at least 20 ms so as to allow the formant extracting section 4 to extract formants in a range of around 100 Hz to around 1 KHz.

Since the formants of the singer have shifted in the speech signals which are pitch controlled in the foregoing manner, the tone color will be changed if emitted via the speakers as they are. For preventing it, the formant extracting section 4 extracts formants of the inputted voice, and the formant filter section 5 carries out a filter operation relative to the pitch-controlled voice so that the pitch-controlled voice has a characteristic of the extracted formants. In this embodiment, the formant extracting section 4 sequentially extracts formants in real time and obtains formant parameters as moving averages thereof. Further, the formant filter operation is similar to processing of a graphic equalizer, wherein speech signals at certain bands are eliminated, while speech signals at certain bands are added. With the foregoing arrangement, a correction can be performed after the pitch control to restore the formant characteristic of the inputted voice so that the change in tone color due to the pitch control can be prevented.

The filter-operated speech signals are once stored in the second buffer 101. Although the speech signals subjected to the filtering represent a voice similar to that of the singer, it is highly possible that the loudness thereof deviates from that of the inputted voice. For preventing it, the input loudness detecting section 6 detects the loudness of the inputted voice, while the loudness detecting section 110 detects the loudness of the filter-operated voice, and the loudness control section 7 compares them and controls the loudness of the filter-operated voice to be equal to the loudness of the inputted voice for an output to the oversampling section 220 (24 KHz sampling/16 bits). In this fashion, the loudness of the voice after the formant correction is finally controlled to the loudness level of the inputted voice by the loudness control section 7.

The speech signal thus processed is converted by the oversampling section 220 into a 48 KHz/20 bit digital signal equal to the musical tone signal of the karaoke system. Then, the speech and musical tone signals are applied with reverb/echo effects necessary for these signals and converted into analog signals by the D/A converter 240 so as to be outputted through the speakers 252*a* and 252*b* of the sound emitting section 250.

Figure 2:
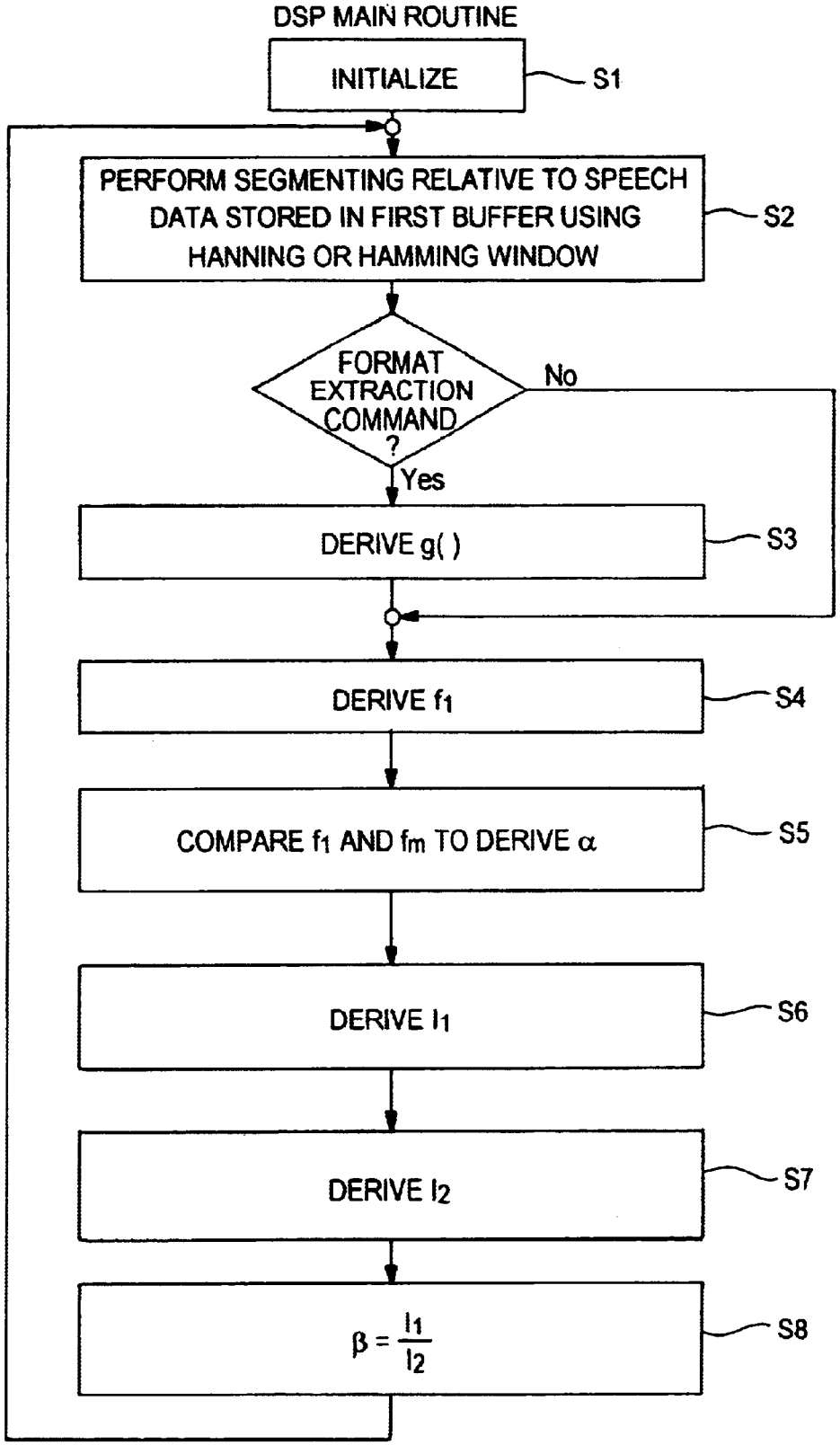
FIG. 2 is a flowchart showing a main routine to be executed by a DSP incorporated in the karaoke system shown in FIG. 1.
Figure 3:
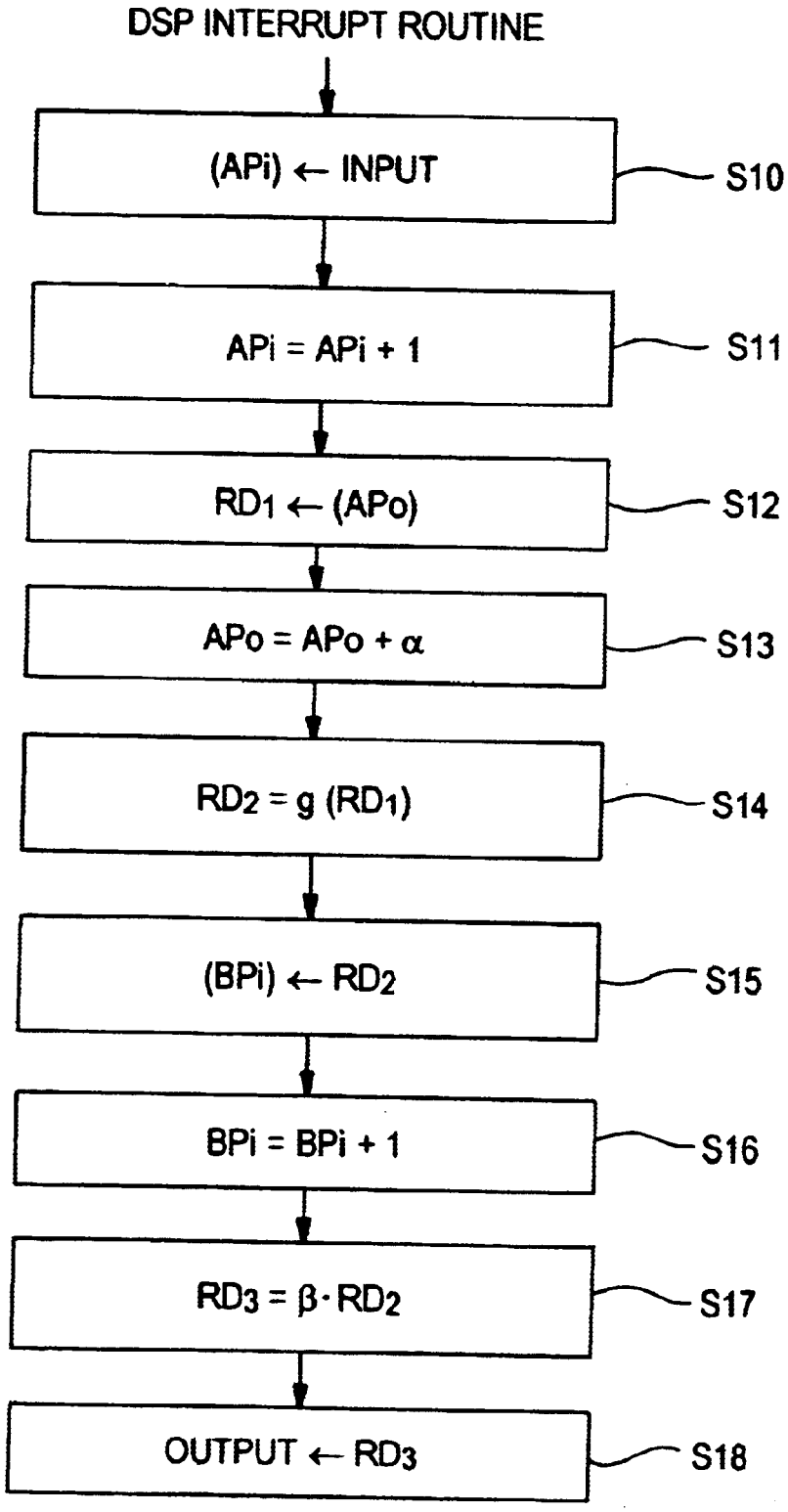
FIG. 3 is a flowchart showing an interrupt routine to be executed by the DSP.

FIG. 2 shows a main routine to be executed by the foregoing DSP. The main routine derives correction values $\alpha$ and $\beta$, and a formant function g() based on a speech (singing voice) signal of about 20 ms (480 samples) stored in each of the first and second buffers 100 and 101. The correction values $\alpha$ and $\beta$ and the formant function g() are used in corresponding process relative to the first buffer 100 carried out in real time (24 KHz sampling) by an interrupt routine as shown in FIG. 3. The main routine has cycle time of about 10 ms.

After the power is on, initialization is executed at step S1. Then at step S2, segmenting is carried out relative to the speech data of about 20 ms stored in the first buffer 100 using a Hanning of Hammming window so as to make it possible to accurately analyze a spectrum whose time window length is not integer times a period.

Subsequently, at step S3, formant extraction in a range of 100 Hz to 1 KHz is carried out to derive a formant function g(). Specifically, at step S3, a number of power spectra each of 20 ms of the speech waveform data segmented by the foregoing window are stored and averaged (moving average) to carry out the formant extraction. The formant extraction is not necessary carried out in every cycle of the main routine. For example, the formant extraction may be carried out only when a formant extraction command is inputted via the formant extraction command key provided on the operation panel 261 and a corresponding trigger signal is sent to the formant extracting section 4. A determination step of "formant extraction command?" provided between steps S2 and S3 represents such a situation.

Subsequently, at step S4, a fundamental frequency $f_1$ is extracted from the segmented waveform data of the first buffer 100.

At step S5, the extracted fundamental frequency $f_1$ and a reference frequency fm (reference pitch) in the melody information are compared with each other to derive an advance rate (correction value) $\alpha$ of a read address relative to the speech waveform data stored in the first buffer 100. In general, the advance rate $\alpha$ takes a value which is in the range of $0.5 \leqq \alpha \leqq 2.0$ and has a decimal part. For example, if f=220 Hz and fm=200 Hz, then $\alpha$=200/220=0,909 · · ·.

At step S6, a loudness $l_1$ of the inputted voice is derived by adding (summing) absolute values of the inputted speech waveform data (sampled values) stored in the first buffer 100 in time sequence.

Similarly, at step S7, by adding (summing) absolute values of the filter-operated speech waveform data stored in the second buffer 101, a loudness $l_2$ of the filter-operated speech waveform data is derived.

At step S8, a loudness correction value $\beta$ for restoring the loudness level of the inputted voice is derived from the loudness $l_1$ and the loudness $l_2$ ($\beta=l_1/l_2$). Then, the routine returns to step S2.

On the other hand, the DSP interrupt routing is executed as shown in FIG. 3.

First at step S10, an input signal (speech sampled data) is inputted and stored into the first buffer 100 {(APi) ←INPUT}. Then at step S11, a storage address of the first buffer 100 is updated (APi=APi+1). At step S12, a stored signal (speech sampled data) is read out from the first buffer 100 {RDi←(APo)}. At step S13, a read address of the first buffer 100 is advanced (APo=APo+$\alpha$) to carry out the pitch control. As appreciated, the pitch control itself is known in the art. At step S14, the read-out speech sampled data is passed through a formant filter (EQU) {$RD_2$=g($RD_1$)≡. Since, as described above, the advance rate $\alpha$ has a decimal part, an interpolated value, corresponding to the decimal part of $\alpha$, between values of two continuous sampled data at APo and APo+1 should be used for the read-out speech sampled data to be passed through the formant filter at step S14. Subsequent steps S15 and S16 are necessary for detecting the foregoing loudness $l_2$. Specifically, at step S15, the filtered sampled data is stored into the second buffer 101 {(BPi)←$RD_2$}. Then at step S16, a storage address of the second buffer 101 is updated (BPi<BPi+1). Subsequently, at step S17, the filtered sampled data is controlled in loudness ($RD_3=\beta \cdot RD_2$). Then at step S18, the loudness-controlled sampled data is outputted (OUTPUT←$RD_3$).

Figure 4:
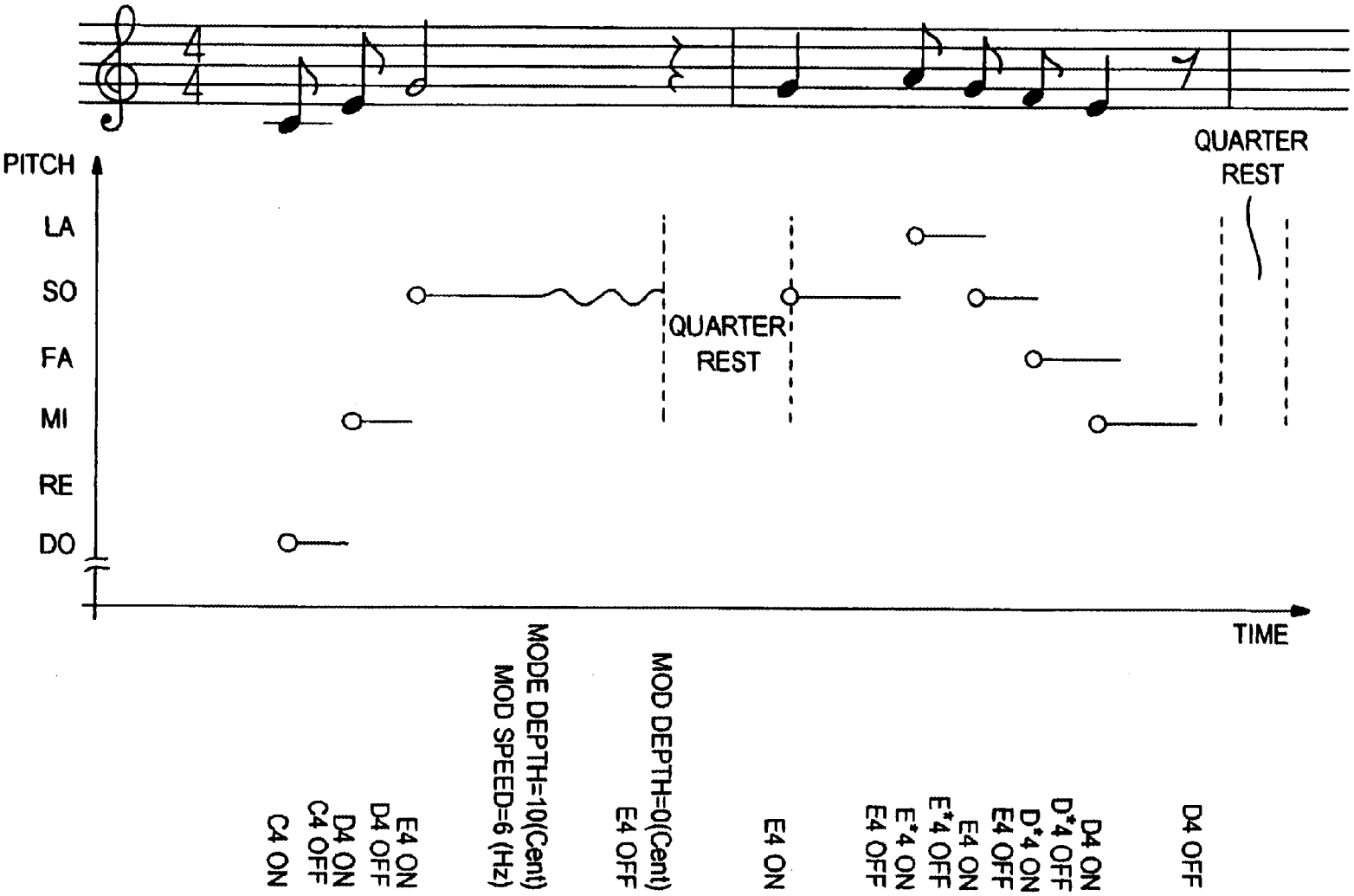
FIG. 4 is an explanatory diagram showing a format of melody information outputted from a host CPU and standard frequencies fm of reference pitches prepared by the DSP.
Figure 5:
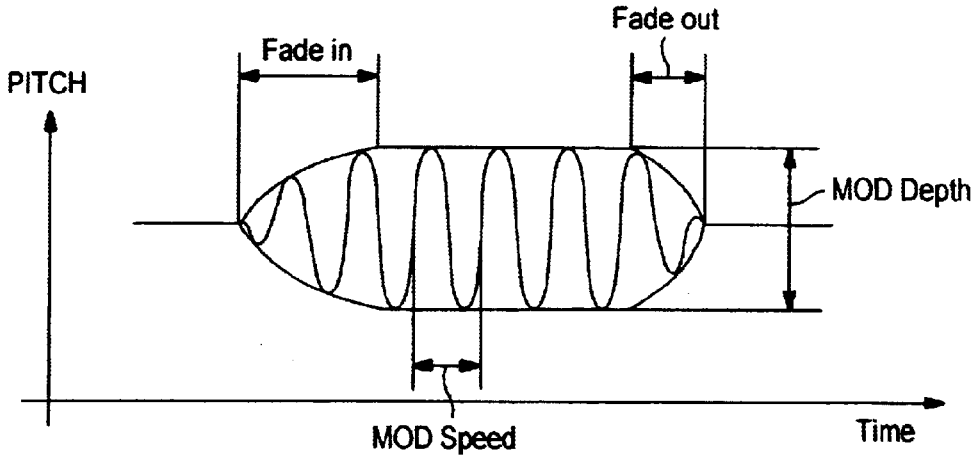
FIG. 5 is an explanatory diagram showing an example of parameters of effects added to the melody information.

FIG. 4 shows a format of the melody information outputted from the host CPU, and the standard frequencies fm of the reference pitches prepared by the DSP. The melody information is MIDI (Musical Instrument Digital Interface) data like the accompaniment information, and information, such as vibrato, which is not regulated in detail in the MIDI is identified by small parameters, such as MOD SPEED, MOD DEPTH. etc. As shown in FIG. 5, other parameters, such as fade-in time and fade-out time, may be further added.

Now, the operation panel 261, the host CPU, the tone generator LSI and the ASP will be described in more detail. The operation panel 261 has a ten-key for music selection, and enter key for notifying completion of music selection or starting a song, a clear or stop key for forcibly stopping a song, a transposing key for transposing pitch information of a song for singing at one's own voice hand, a RevDepth key for controlling a reverb depth, and a position key for arbitrarily setting localization of a singer. The operation panel 261 may also have a formant extraction command key for carrying out formant extraction only once to several times according to necessity. In this embodiment, since the formant extraction is constantly carried out, an extraction command using the formant extraction command key is not normally performed.

As described before, the pitch sequence is the data that is stored corresponding to even changes. Accordingly, an output manner of the host CPU is of an event type corresponding thereto so that the host CPU outputs according to the MIDI or in a higher compatible manner.

The tone generator LSI is constituted of a 32–64 tone polyphonic generator which is generally adopted in an electronic musical instrument. The tone generator LSI receives the accompaniment information from the host CPU and outputs it as stereo digital musical tone signals (48 KHz sampling/20 bits).

The ASP constituting the effect adding section 210, the oversampling section 220 and the reverb section 230 has a structure similar to that of the DSP. However, in general, the number of program steps of the ASP is as small as the number of steps which can be executed by the ASP within one sampling time. Accordingly, it is unsuitable for the fundamental frequency or formant extracting process performed by the DSP, wherein the fundamental frequency or the formant is extracted over a period longer than one sampling time. The reverb section 230 controls the reverb depth on the musical tone and speech signals based on the information from the host CPU, and further realizes the localization designated on the operation panel 261 by passing only the speech signals (other than the musical tone signals representing the accompaniment tones) through a delya/feedback system. An output of the ASP is in the form of a serial signal representing L/R stereo signals in a time-division manner so as to match with a general digital audio signal (FDC format).

As described above, in this embodiment, the formant extraction is sequentially carried out in real time and the formant parameters are obtained as the moving averages thereof. On the other hand, the formant extraction may be carried out at given time intervals, at random or on an instant. For example, the formant extraction may be carried out once at a timing other than singing, such as before singing, using the formant extraction command key of the operation panel 261, and the extracted formant characteristic may be used during singing. In this case, it is also possible to change the tone color by extracting formants of a person other than a singer.

Figure 6:
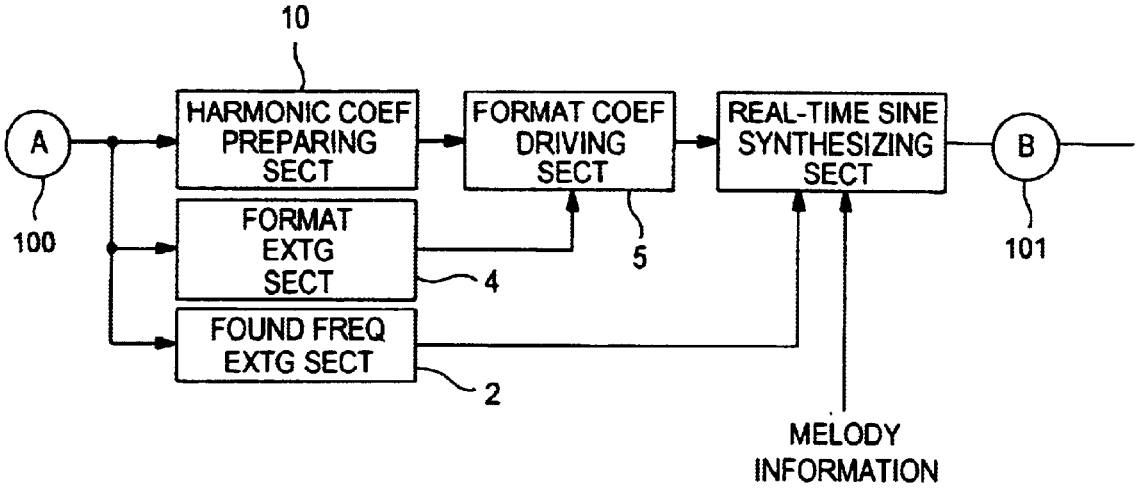
FIG. 6 is a functional block diagram showing a range control system according to a second preferred embodiment of the present invention, wherein a DSP once converts speech information into harmonic coefficient data and then restores it through sine synthesis.

In the foregoing first preferred embodiment, the DSP performs the pitch control and the filtering of the PCM waveforms. However, the present invention is not limited thereto. For example, as shown in FIG. 6, it may be arranged that the speech data stored in the first buffer 100 is inputted into a harmonic coefficient preparing section 10 to device harmonic coefficient data using a frequency Fourier transforms (FFT), then a formant coefficient control is carried out relative to the harmonic coefficient data, then harmonic coefficient synthesis (sine synthesis) is carried out in real time at changed pitches to restore a speech waveform, and thereafter, a loudness control is performed.

In the karaoke singing backup systems according to the preferred embodiments of the present invention, although it is premised on using default values stored in library of songs for determining the performance speed (tempo) of the selected song, it is easy to change the performance speed through an operation of the operation panel 261. However, in the system wherein the speech waveforms are processed as PCM data in the DSP, the pitch control becomes difficult if, with respect to the speech waveform sampled data stored in the first buffer 100, reading is repeated in a partly jumping fashion (by decimating sequence addresses) for raising the pitch or each sample thereof is read out more than once for lowering the pitch. When performing such a pitch raising or lowering process, it is necessary to ensure smooth continuation relative to the next speech waveform. In the foregoing system as shown in FIG. 6 where the speech waveform is once converted into the harmonic coefficient data and then restored by the sine synthesis, no problem is raised in connection with such a point.

According to the range control system of each of the foregoing preferred embodiments of the present invention, even when the range of the inputted voice is expanded, the color tone is not spoiled, and further, the loudness of the finally outputted voice can be corrected to the loudness level of the inputted voice.

When such a range control system is used for the singing backup system, a singer can sing a song at a voice range broader than one's own voice range while maintaining the tone color and the loudness of the original singing voice.

Further, when such a range control system is used for the pronunciation backup system in, for example, chanting a Chinese poem or a sutra, or reading aloud a foreign language, it is possible for a beginner to emit tones with the same intonation as that of a skilled person without spoiling one's own tone color.

Moreover, depending on the manner of the formant extraction as noted before, it is possible to sing, chant a Chinese poem or a sutra or read aloud a foreign language with a tone color of another person.

While the present invention has been described in terms of the preferred embodiments, the invention is not to be limited thereto, but can be embodied in various ways without departing from the principle of the invention as defined in the appended claims.

What is claimed is:

1. A range control system comprising:

an input section for inputting a voice in real time;

a fundamental frequency extracting section for extracting a fundamental frequency of the inputted voice;

a pitch control section for performing a pitch control of the inputted voice whereby the extracted fundamental frequency is compared to a given frequency and the extracted fundamental frequency is matched with said given frequency;

a formant extracting section for extracting a formant of the inputted voice; and a formant filter section for performing a filter operation relative to the pitch-controlled voice so that the pitch-controlled voice has a characteristic of the extracted formant.

2. The range control system according to claim 1, further comprising:

a storage section storing a plurality of selectable pitch sequences as reference pitches; and a reading section for selecting one of the pitch sequences and sequentially reading the corresponding reference pitches, wherein said given frequency is a frequency of the corresponding reference pitch read out by said reading section.

3. The range control system according to claim 2, wherein said storage section stores each of said pitch sequences corresponding to event changes, while storing acoustic effect data having periodic changes of pitches as parameters of time, depth and speed.

4. The range control system according to claim 1, further comprising:

an input loudness detecting section for detecting a first loudness of the inputted voice; and a loudness control section for controlling a second loudness of the voice subjected to the filter operation to match with said first loudness.

5. The range control system according to claim 4, wherein said loudness control section controls said second loudness based on a ratio between said first loudness and a third loudness of the voice subjected to the filter operation, said third loudness detected by a loudness detecting section.

6. The range control system according to claim 1, wherein said formant extracting section sequentially extracts formants of the inputted voice.

7. A range control system comprising:

an input section for inputting a voice in real time;

a fundamental frequency extracting section for extracting a fundamental frequency of the inputted voice;

a pitch control section for performing a pitch control of the inputted voice whereby the extracted fundamental frequency is compared to a given frequency and the extracted fundamental frequency is matched with said given frequency;

a formant extracting section for extracting a formant of the inputted voice;

a formant filter section for performing a filter operation relative to the pitch-controlled voice so that the pitch-controlled voice has a characteristic of the extracted formant;

an input loudness detecting section for detecting a first loudness of the inputted voice; and a loudness control section for controlling a second loudness of the voice subjected to the filter operation to match with said first loudness;

a storage section storing a plurality of selectable pitch sequences as reference pitches; and a reading section for selecting one of the pitch sequences and sequentially reading the corresponding reference pitches, wherein said given frequency is a frequency of the corresponding reference pitch read out by said reading section.

8. The range control system according to claim 7, wherein said loudness control section controls said second loudness based on a ratio between said first loudness and a third loudness of the voice subjected to the filter operation, said third loudness detected by a loudness detecting section.

9. The range control system according to claim 7, wherein said formant extracting section sequentially extracts formants of the inputted voice.

10. The range control system according to claim 7, wherein said storage section stores each of said pitch sequences corresponding to event changes, while storing acoustic effect data having periodic changes of pitches as parameters of time, depth and speed.

* * * * *